United States Patent [19]

Hakkarainen et al.

[11] Patent Number: 4,902,053

[45] Date of Patent: Feb. 20, 1990

[54] DOOR LOCK

[75] Inventors: Reijo Hakkarainen; Keijo Lehikoinen; Paavo Piiroinen, all of Joensuu, Finland

[73] Assignee: Oy Wärtsilä Ab, Helsinki, Finland

[21] Appl. No.: 376,168

[22] Filed: Jul. 5, 1989

Related U.S. Application Data

[63] Continuation of Ser. No. 176,839, Apr. 4, 1988, abandoned.

[30] Foreign Application Priority Data

Apr. 13, 1987 [FI] Finland ..... 871601

[51] Int. Cl.[4] ..... E05C 5/02

[52] U.S. Cl. ..... 292/144; 292/66; 292/192

[58] Field of Search ..... 292/66, 144, 153, 191, 292/192, 210, 335, 336

[56] References Cited

U.S. PATENT DOCUMENTS

| | | | |
|---|---|---|---|
| 473,061 | 4/1892 | Crockett et al. | 292/192 |
| 1,215,992 | 2/1917 | Rein | 292/192 X |
| 2,668,073 | 2/1954 | Collar et al. | 292/192 |
| 2,726,890 | 12/1955 | Teetor | 292/192 |
| 3,492,038 | 1/1970 | Schlage et al. | 292/78 |
| 3,582,119 | 6/1971 | Woodworth | 292/27 |
| 4,615,550 | 10/1986 | Abate | 292/192 |

FOREIGN PATENT DOCUMENTS

| | | |
|---|---|---|
| 2240894 | 8/1972 | Fed. Rep. of Germany . |
| 224328 | 1/1969 | Sweden . |

*Primary Examiner*—Richard E. Moore

*Attorney, Agent, or Firm*—Dellett, Smith-Hill & Bedell

[57] ABSTRACT

The invention relates to a door lock, which comprises, a lock body (1) provided with a forend and including a latch bolt (3), which is removable between a retracted position and a protruding, locking position out from the lock body through an opening (2*a*) in the forend (2) and which is spring-loaded towards its said protruding position, and dead locking means turnable from a passive position into a dead locking position, in which they prevent removal of the latch bolt (3) from its said protruding position into its retracted position in the lock body (1). According to the invention the latch bolt (3) comprises a body of the latch bolt (3*a*) and a separate latch bolt member (3*b*). The latch bolt member (3*b*) is supported on the body of the latch bolt (3*a*) so as to be turnable substantially around a longitudinal axis (24) of the lock body and formed to narrow down in a wedge-like manner towards the outer edge thereof, said bevelled part of the latch bolt member (3*b*) extending, in the protruding position of the latch bolt (3), substantially out from the lock body (1).

18 Claims, 3 Drawing Sheets

DOOR LOCK

Figure 1:
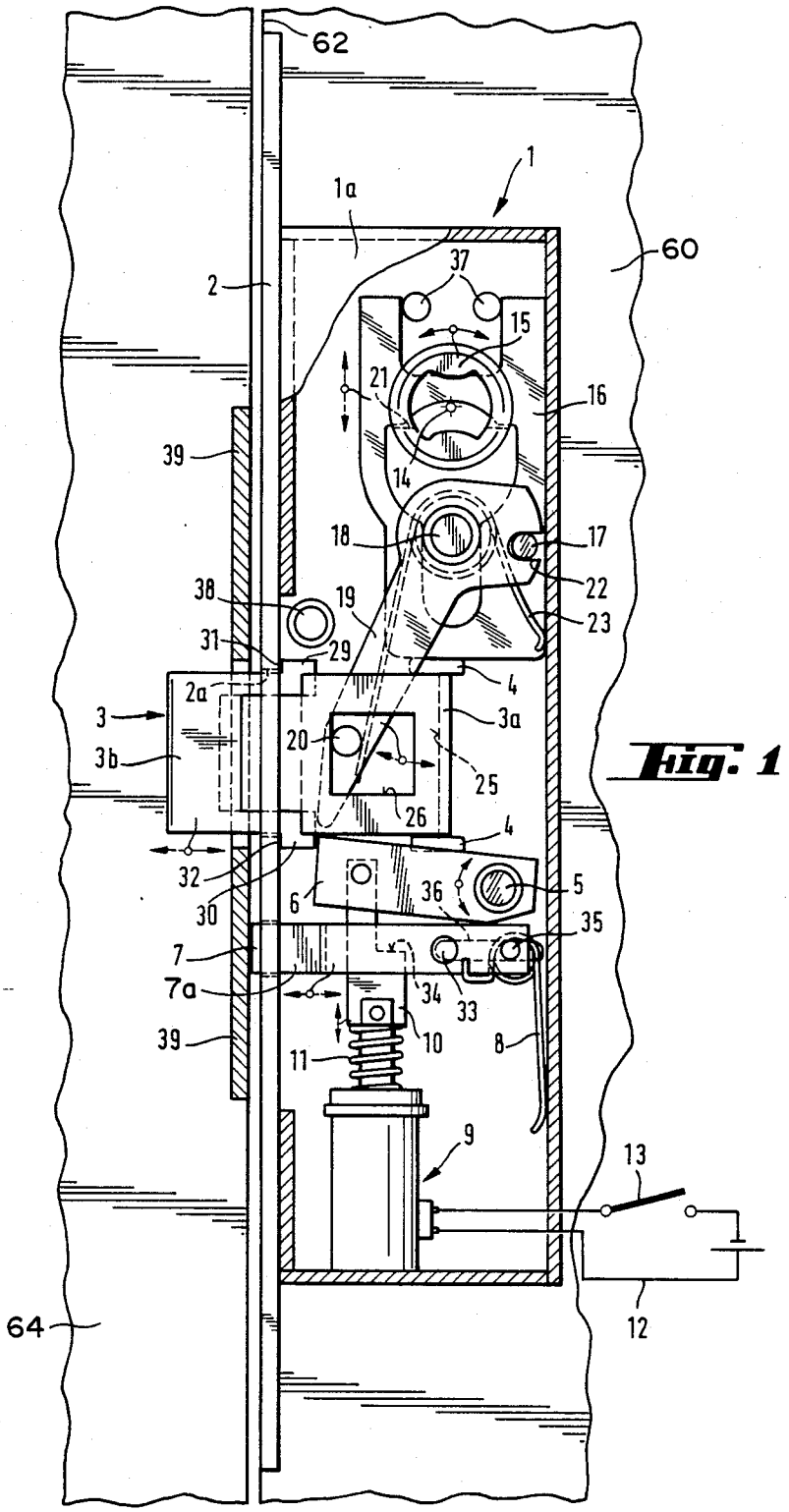

This is a continuation of application Ser. No. 07/176,839 filed Apr. 4, 1988, now abandoned.

The invention relates to a door lock.

Door locks have to meet different requirements and objects in accordance with the place of employment, for instance a fire-door, staircase door or an office door, and the situation of operation, e.g. day-time operation or night-time operation. Thus, there can be a requirement for instance that from one side it is possible to open the lock only by key and from the other side either by key or alternatively by a handle or a turn knob. Another requirement can be that the lock should be provided with dead-locking possibility, whereby there are several options available as to how to set the lock into a dead-locked position and how to withdraw the dead-locking.

Certain inconsistency is caused on one hand by the security requirements set for passage through a door and on the other hand by the need for effortless passage as well as operation of the lock in certain places of employment especially in a day-time operation situation. Then there may be a desire that locking can be caused and withdrawn also through remote-control for different situations of operation, and additionally that the bolt need not be separately moved by means of an actuating device or an operation device and, nevertheless, the door can be opened, if desired, for instance simply through pushing or pulling action. One solution for this kind of locking situation is offered by electrically controlled striking plate devices for locks in combination with a door lock provided with a latch bolt. According to these solutions a striking plate for the door lock, installed at the door frame, is provided with a stop member, which can be moved, under the control for instance of a solenoid, between a locked and yielding position. Then in the yielding position of the stop member the door can be pushed open although the latch bolt is in its protruding position out from the lock body. When the door is closed, the bevelled surface of the latch bolt hits in a normal way the striking plate, which presses the latch bolt into its retracted position in the lock body. Then the door can be shut and the latch bolt resumes its protruding, locked position urged by spring means.

This electrically controlled striking plate arrangement is troublesome to install at certain places of employment and especially as a substituting installation. The arrangement is rather expensive as well, for in many places of employment, irrespective of providing an electrically controlled striking plate unit, a door lock provided with versatile options for operation, such as key operation and dead-locking possibility, needs to be installed to the door as well.

One aim of the invention is to create a novel and favorable arrangement, which is especially well adapted to the locking situation described above and from which the drawbacks in the prior art have been eliminated. A further aim of the invention is to create such a basic arrangement for a door lock, that can with advantage be adapted to several different places of employment and situations of operation and which is uncomplicated as to its construction and is reliable to operate.

The aims of the invention are met through use of a novel latch bolt construction, in which the latch bolt comprises a body of the latch bolt and a separate latch bolt member, the latch bolt member being supported on the body of the latch bolt so as to be turnable substantially around a longitudinal axis of the lock body and formed to narrow down a wedge-like manner towards the outer edge thereof, said bevelled part of the latch bolt member extending, in the protruding position of the latch bolt, substantially out from the lock body. The door can be opened simply by pushing in either direction when the dead locking means are in their passive position. On the other hand unjustifiable passage can be prevented by transferring the dead locking means into the dead locking position.

The latch bolt member is favorably provided with guiding members extending substantially in the longitudinal direction of the latch bolt and supported on opposite sides of the body of the latch bolt in the longitudinal direction of the lock body. In practice an arrangement with smooth operation has proved to be one wherein the latch bolt member comprises, in the longitudinal direction of the lock body, two separate parts independently turnable with regard to each other.

It is of advantage to provide said guiding members of the latch bolt member with a protrusion, extending, in the longitudinal direction of the lock body, outwards from the latch bolt and including a stop surface arranged to co-operate with the inner surface of the front plate of the lock for guiding the turning movement of the latch bolt member and for defining the protruding length of the latch bolt out from the lock body. Thereby, when a spring urges the latch bolt outwards, said stop surface causes the latch bolt member or the parts thereof to turn into a certain basic position.

The body of the latch bolt is favorably designed such that it defines an inner space, which in the transversal direction of the lock body is of substantial extension and in the longitudinal direction of the lock body is open at the upper and lower ends thereof. Thus the lock can more easily be provided with additional functions, which may require that members on opposite sides of the body of the latch bolt in the longitudinal direction of the lock body be operationally connected with respect to each other.

Both the body of the latch bolt and the latch bolt member are with advantage provided with stop surfaces arranged to co-operate with respect to each other so as to limit the turning range of the latch bolt member with regard to the body of the latch bolt such that in the end positions of the turning range either one of the side surfaces of the bevelled latch bolt member is substantially parallel with the longitudinal axis of the latch bolt.

The dead locking means include favorably a dead locking member, for instance a lever, turnably supported in the lock body and co-operating, in its dead locking position, with said protrusion in the guiding member of the latch bolt member. The dead locking member can with advantage be urged by a spring towards its dead locking position, and the lock body can be provided with an operation device, for instance solenoid means, for moving the dead locking member against the force of said spring into its passive position and, thus, for freeing the latch bolt to be moved into its retracted position in the lock body. Thereby dead locking can with ease be set and withdrawn also under remote-control and the door lock itself be set for day-time or night-time operation.

For different places of employment it is of advantage to provide the door lock according to the invention with an operating shaft, on which can be installed operation devices, for instance a key operated locking mechanism, a handle, a turn knob, or the like, and force transmission means, by means of which, by making use of an operation device installed on the operating shaft, the dead locking member is removable away from its dead locking position. Said force transmission means can then favorably include a force transmission lever, which is turnably supported in the lock body, and is located partly in the inner space of the body of the latch bolt, and is arranged in force-transmitting connection with the body of the latch bolt for withdrawing the latch bolt and is simultaneously further arranged, through its turning movement, to remove the dead locking member. Thus the door lock according to the invention can be used in a controlled way also when the dead locking means are activated, for instance when the lock has been set for night-time operation.

In practice it is of advantage to provide the door lock with an auxiliary bolt having a bevelled end, being reciprocatingly movable in a known way, and arranged to prevent, in its protruding position out from the lock body, the removal of the dead locking lever into its dead locking position.

Figure 2:
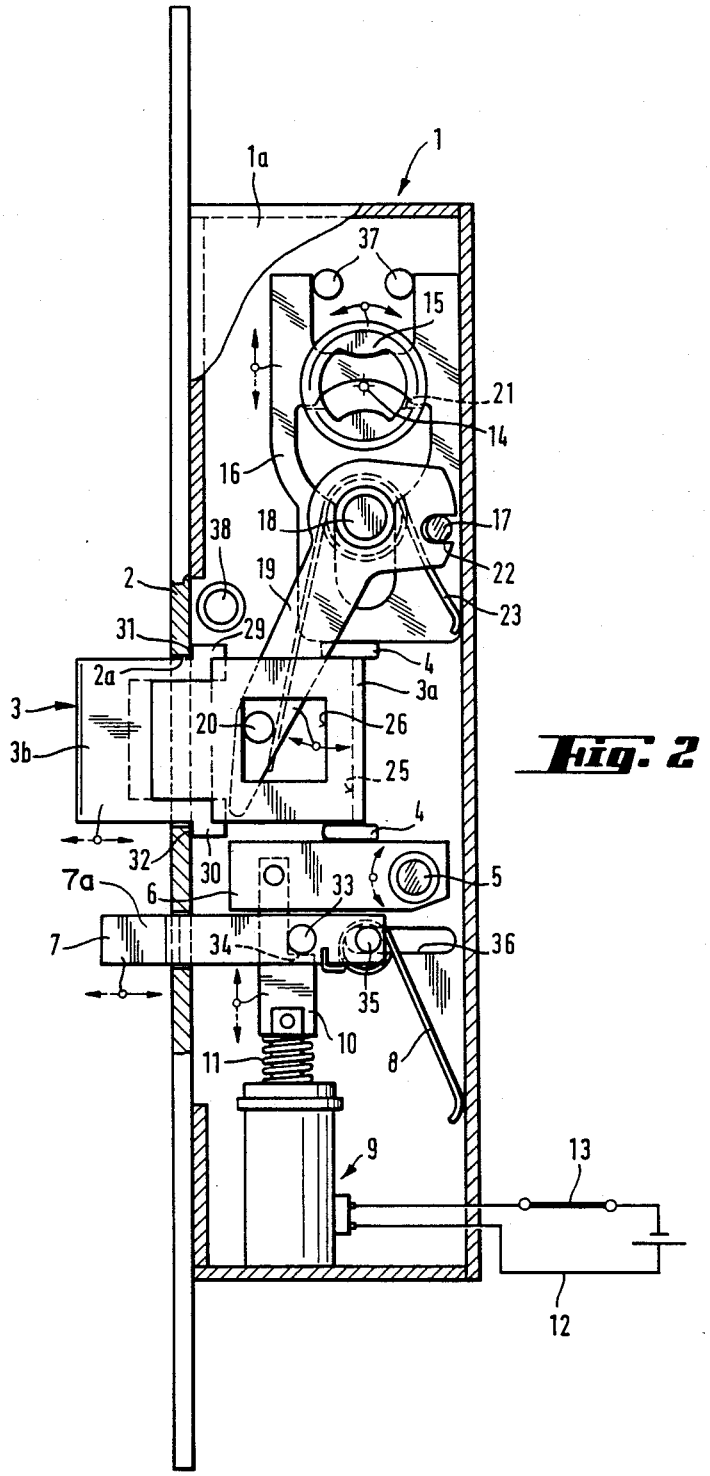
Figures 3A, 3B, 4A, 4B, 5A, 5B:
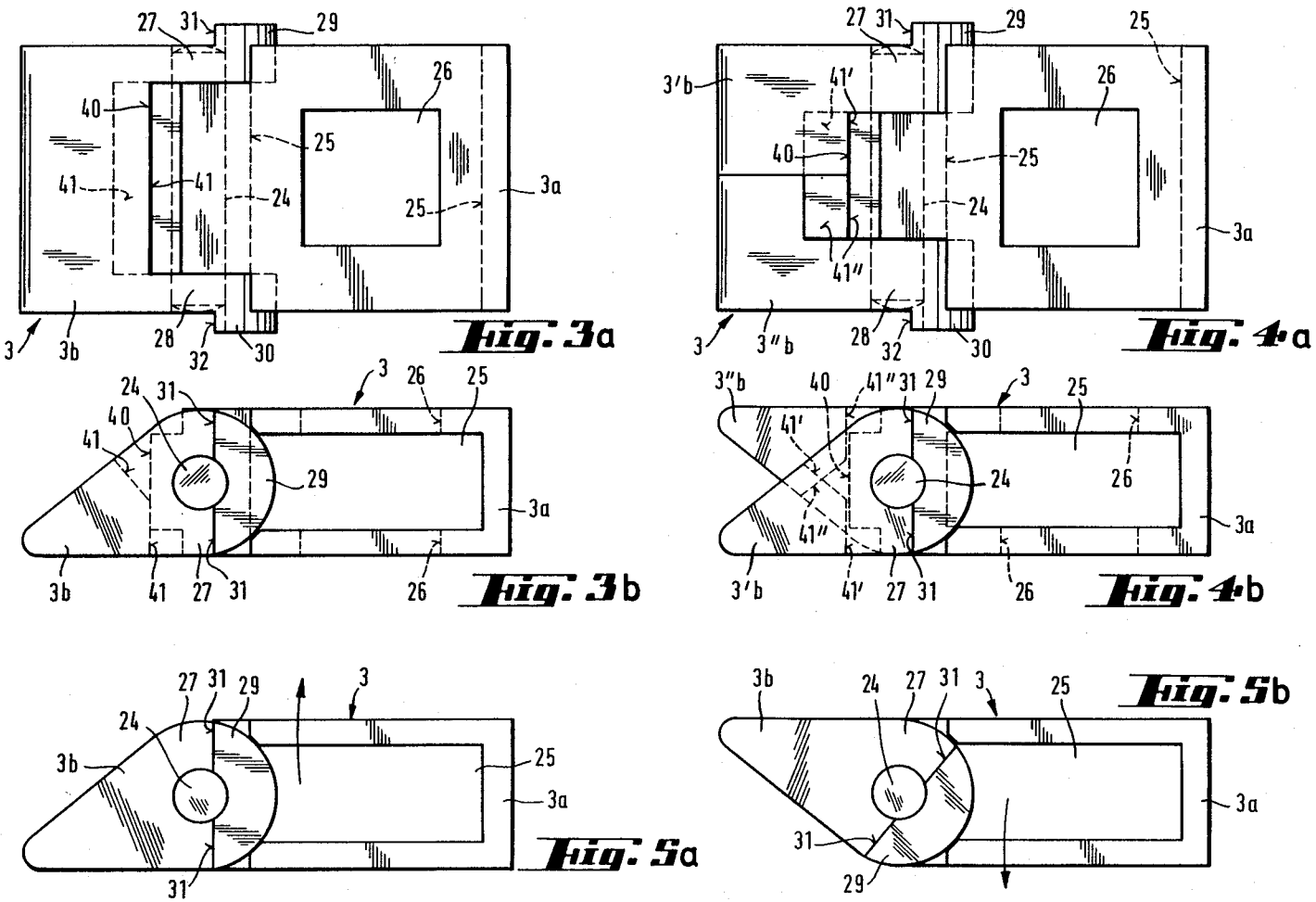

In the following the invention is described more in detail with reference to the attached drawings, in which FIG. 1 shows an embodiment of a door lock according to the invention with the lock body opened and the dead locking means in a dead locking position, FIG. 2 shows the door lock of FIG. 1 with the dead locking means in a passive position, FIGS. 3*a* and 3*b* show an embodiment of a latch bolt for a door lock according to the invention viewed from side and from above, FIGS. 4*a* and 4*b* show another embodiment of a latch bolt for a door lock according to the invention viewed from side and from above, FIGS. 5*a* and 5*b* show the latch bolt of FIG. 3 in two operating positions.

In the drawings the reference numeral 1 indicates a lock body, which includes a front slate 2. The lock body 1 is mounted in a door 60 at an edge 62 thereof. The door 60 is turnable relative to a door frame 64 about a turning axis that is parallel to the edge 62. The lock body is provided with a latch bolt 3, which is movable in directions perpendicular to the turning axis of the door between a protruding, locking position and a retracted position in the lock body through an opening 2*a* in the front plate. The lock body includes guiding members 4 for guiding the movements of the latch bolt 3. Openings 37 and a supporting sleeve 38 are availed of to fix a lock cover 1*a* to the lock body 1. To provide dead locking operation for the latch bolt 3 the lock body comprises, a dead locking lever 6 turnably journalled to a pivot pin 5, an auxiliary bolt 7, a spring 8 urging the auxiliary bolt out from the lock body, solenoid means 9, a setting member 10 connecting the solenoid means 9 to the dead locking lever 6, and a spring 11, which through the setting member 10 is adapted to press the dead locking lever 6 into its dead locking position. In the drawing remote controlled activation and deactivation of the solenoid means 9 is shown only schematically with a circuit 12 and a switch 13.

The lock body is also provided with an operating shaft 14, on which can be installed on both sides of the lock body, depending on the place of operation, alternatively for instance a key operated lock mechanism, a handle, a turn knob, or the like (these are not shown in the drawings). From these operating devices the latch bolt 3 can be withdrawn from its protruding position into the lock body through means, which include a turnable force transmission member 15, a reciprocatingly movable force transmission plate 16 positioned in a transversal groove thereof and provided with a force transmission pin 17, and, turnably journalled to the pivot pin 18, a force transmission lever 19 having a guiding groove 22 and including a force transmission pin 20 acting on the latch bolt 3. Guiding surfaces 21 in the groove of the force transmission member 15 transform the turning movement of the member 15 into a linear movement of the force transmission plate 16, and this linear movement is further transformed, through the pin 17 of the plate 16 and the guiding groove 22 of the force transmission lever 19, into a turning movement of the lever 19.

Thus the latch bolt 3 is withdrawn into the lock body by means of the force transmission pin 20. In addition to this also the returning of the latch bolt out from the lock body into the protruding position is accomplished through the force transmission pin 20. Therefore the lock body is provided with a spring 23, which acts on the force transmission pin 20 urging the force transmission lever 19 to turn in the clockwise direction in FIGS. 1 and 2.

The construction of the latch bolt 3 for a door lock according to the invention is more precisely disclosed in FIGS. 3*a* and 3*b* as well as 4*a* and 4*b*. The latch bolt comprises two basic parts; a body of the latch bolt 3*a* and, a wedge-like latch bolt member 3*b* turnably supported thereto on a shaft 24 parallel to the turning axis of the door and extending out from the lock body when the latch bolt is in its locking position. The body of the latch bolt 3*a* is formed such that it confines an inner space 25, which is open from the upper and from the lower side thereof and in which the force transmission lever 19 is partly arranged, as is apparent from FIGS. 1 and 2. In addition the body of the latch bolt 3*a* is provided with side openings 26 for the force transmission pin 20.

The latch bolt member 3*b* includes guiding members 27 and 28. These are provided with protrusions 29 and 30, which for their part include stop surfaces 31 and 32, which co-operate with the inner surface of the front plate 2 of the lock. In addition the protrusion 30 of the guiding member 28 co-operates with the dead locking lever 6 for providing dead locking. As is apparent from FIGS. 4*a* and 4*b*, the latch bolt member 3*b* can alternatively comprise two mutually independently turnable parts 3'*b* and 3''*b*.

The latch bolt member 3*b* as well as the parts 3'*b* and 3''*b* are also provided with stop surfaces 41, 41' and 41'' respectively. These are arranged to co-operate with a stop surface 40 in the body of the latch bolt 3*a* for the purpose of limiting, possibly together with the side surfaces (not shown in the drawings) in the opening 2*a* of the front plate 2, the turning range of the latch bolt member relative to the body of the latch bolt. Additionally these stop surfaces assist in pressing the latch bolt into the retracted position in the lock body when the door is turned and the latch bolt meets an obstacle, as is more clearly described below. Finally these stop surfaces make the arrangement according to the invention sturdy and able to resist efforts to break up the latch bolt by force.

The operation of the latch bolt and of the dead locking means of the door lock shown in the drawings is as follows. With reference to FIG. 1, when the switch 13 is open and hence the circuit 12 is not connected, the solenoid means 9 are in a passive condition. Thereby the spring 11 presses, through the setting member 10, the dead locking lever 6 into its dead locking position, in which it co-operates with the protrusion 30 in the guiding member 28 of the latch bolt member 3*b*. In this event the latch bolt 3 can be withdrawn into the lock body only by means of operating devices installed on the operation shaft 14. When this occurs, the force transmission lever 19 turns in the counter-clockwise direction according to FIG. 1 and at the same time presses the dead locking lever 6 into a position, in which it allows the latch bolt 3 to be moved into the lock body 1. Simultaneously the setting member 10 moves downwards in FIG. 1 against the force of the spring 11. The spring 8 urges the auxiliary bolt 7 outwards from the lock body, but when the door is closed, a striking plate 39 in the door frame prevents movement of the auxiliary bolt. The movements of the auxiliary bolt 7 are guided by the guiding pin 35 and the guiding groove 36 made in the lock body.

When latch bolt 3 is entirely withdrawn in the lock body and the door has been pushed open past the striking plate 39, both the latch bolt 3 and the auxiliary bolt 7 move, urged by the springs 23 and 8 respectively, into the protruding position according to FIG. 2. At the same time the pin 33 of the auxiliary bolt 7 has engaged a step 34 in the setting member 10 thereby preventing the spring 11 and the setting member 10 from moving the dead locking lever 6 into its dead locking position, because the latch bolt 3 being in its outer, protruding position the protrusion 30 and the force transmission lever 19 no longer prevent the dead locking lever 6 from entering into the dead locking position. Hence, when the door is being shut and the bevelled surface of the latch bolt 3 hits the striking plate 39 in the door frame, the latch bolt 3 is free to move, pressed by the striking plate 39, into the lock body 1 and the door can be closed. At the same time a bevelled portion 7*a* of the auxiliary bolt 7 strikes the plate 39 and the auxiliary bolt 7 is pressed into the lock body and the pin 33 of the auxiliary bolt, respectively, moves away from the step 34. Thus, the spring 23 again having moved the latch bolt 3 out from the lock body into the latch opening in the striking plate 39 and the solenoid means 9 still being in the non-connected state, the spring 11 moves the setting member 10 upwards in the figure, whereby the locking lever 6, respectively, moves again into the dead locking position shown in FIG. 1.

In FIG. 2, on the other hand, the switch 13 is closed and, consequently, the circuit 12 is connected. Hence the solenoid means 9 are in the active condition and arranged to draw, with the assistance of the setting member 10, the dead locking lever 6 away from its dead locking position into the position of FIG. 2, in which the dead locking lever 6 remains as long as the circuit 13 is connected. In this event the door can be pushed or pulled open and shut in whichever direction thanks to the turnable and wedge-like latch bolt member 3*b* of the latch bolt 3 and due to the fact that the dead locking lever 6 allows the latch bolt 3 to be pressed into the lock body.

FIGS. 5*a* and 5*b* illustrate more precisely the operation of the latch bolt member 3*b* of the latch bolt 3, which is corresponding independent on the fact, whether the latch bolt member comprises one part as is shown in FIGS. 3*a* and 3*b* or two parts as is shown in FIGS. 4*a* and 4*b*. With reference to FIG. 5*a* the stop surface 31 is normally pressed against the inner surface of the front plate 2 of the door lock and defines the basic position of the latch bolt member 3*b*. When the door is turned in the direction of the arrow, the position of the latch bolt member 3*b* does not change when the latch bolt 3 meets an obstacle, i.e. a counter surface in the striking plate 39 located in the door frame, but the result is that said counter surface presses the latch bolt 3 into the lock body. On the other hand when the door is turned in the direction of the arrow in FIG. 5*b* and the latch bolt meets an obstacle, the latch bolt member 3*b* turns from the position of FIG. 5*a* to the position of FIG. 5*b* and the latch bolt 3 moves simultaneously somewhat inwards into the lock body. In case the door is pushed further in the same direction, the latch bolt moves again entirely into the lock body. When the latch bolt 3, urged by its spring, again is allowed to move out from the lock body into its protruding position, the edge of the stop surface 31 is first to hit on the inner surface of the front plate 2. Urged by the spring 23 the latch bolt member 3*b* then turns back into the basic position of FIG. 5*a*, in which the entire stop surface 31 is pressed against the front plate 2. The guiding operation of the stop surfaces 31 and 32 is naturally fully analogous.

On the grounds of what is described above it is clear that in the latch bolt arrangement of FIGS. 4*a* and 4*b* each time when the latch bolt 3 meets an obstacle, i.e. the striking plate 39 for the lock, one of the latch bolt members 3'*b* or 3''*b* is already in the basic position as described above and the other 3''*b* or 3'*b* turns respectively. Thus the operation the latch bolt 3 according to this embodiment is as smooth in either turning direction of the door.

Naturally, the latch bolt member 3*b* can be journalled to the body of the latch bolt 3*a* in many different ways. For instance a separate stub shaft can be used, or the member 3*b* of the bolt 3*a* can be provided with fixed pivot pins etc. Also the dead locking means and the operation thereof can be provided in many different ways in practice. Depending on the place of operation a pulling or a pushing solenoid or for instance a small electric motor can be used. In the same manner the selection of operating devices to be installed on the operating shaft and the fact, whether said operating devices can only move the dead locking member away from the dead locking position or can simultaneously also move the latch bolt into the lock body, as well as the necessity for the operating shaft depend on the place of operation.

Thus the invention is not restricted on the embodiments shown but several modifications are feasible within the scope of the attached claims.

We claim:

1. A door lock suitable for installation in a door that is turnable about a predetermined axis, said door lock comprising:

a lock casing having a front plate formed with an opening, a latch bolt comprising a latch bolt body and a latch bolt member, the latch bolt being movable linearly in directions perpendicular to the turning axis of the door between a retracted position in which substantially the entire latch bolt is inside the lock clasing and a projecting position in which the latch bolt body is inside the lock casing and a wedge portion of the latch bolt member projects from the lock casing through the opening in the front plate, the latch bolt member extending beyond the latch bolt body in the direction of movement of the latch bolt from the retracted position towards the projecting position and being connected to the latch bolt body in a manner permitting pivotal movement of the latch bolt member relative to the latch bolt body about a pivot axis parallel to the turning axis of the door, and said wedge portion of the latch bolt member being defined by two opposite faces that converge in a direction away from the pivot axis towards an end that extends substantially parallel to said pivot axis, said opposite faces converging over substantially the entire amount by which the latch bolt member projects from the lock casing when the latch bolt is in its projecting position, spring means urging the latch bolt towards the projecting position, and dead locking means selectively operable when the latch bolt is in the projecting position to prevent movement of the latch bolt towards the retracted position.

2. A door lock according to claim 1, wherein the latch bolt member comprises two components that are pivotable independently of each other relative to the latch bolt body about said pivot axis.

3. A door lock according to claim 2, wherein each component of the latch bolt member has a wedge portion defined by two opposite faces that converge in a direction away from the pivot axis towards an end surface that extends substantially parallel to the pivot axis.

4. A door lock according to claim 1, wherein the latch bolt member comprises guide portions that extend substantially in the direction of the movement of the latch bolt and are spaced apart along said pivot axis, and the latch bolt body has a guide portion that extends between the guide portions of the latch bolt member and to which the latch bolt member is attached by way of its guide portions.

5. A door lock according to claim 4, wherein the latch bolt member is connected to the latch bolt body by a pivot shaft that extends through the guide portions of the latch bolt member and the guide portion of the latch bolt body.

6. A door lock according to claim 4, wherein the guide portions of the latch bolt member each comprise a protrusion extending in a direction parallel to the pivot axis, away from the latch bolt body, and having a stop surface arranged to cooperate with an inner surface of the front plate for guiding pivotal movement of the latch bolt member and defining the amount by which the latch bolt member may project from the lock casing when the latch bolt is in the projecting position.

7. A door lock according to claim 1, wherein the latch bolt body has upper and lower surfaces that are substantially perpendicular to the pivot axis, and is formed with a passage that extends through the lock bolt body and opens at the upper and lower surfaces, the passage being of substantial extension in the direction of movement of the latch bolt.

8. A door lock according to claim 1, wherein the dead locking means include a dead locking member that is pivotable relative to the lock casing, about an axis that is stationary relative to the lock casing, between a dead locking position in which the dead locking member engages the latch bolt to prevent movement of the latch bolt from the projecting position to the retracted position and a passive position in which it allows the latch bolt to be moved from its projecting position towards its retracted position.

9. A door lock according to claim 8, comprising second spring means urging the dead locking member towards its dead locking position, and an operation device for moving the dead locking member to its passive position against the force of the second spring means.

10. A door lock according to claim 8, comprising an operating shaft that is operable to move the dead locking member from its dead locking position towards its passive position.

11. A door lock according to claim 10, wherein the operating shaft is coupled to a force transmission lever which is pivotable within the lock casing and is drivingly engaged with the latch bolt for moving the latch bolt from its projecting position to its retracted position, and wherein pivotal movement of the force transmission lever brings about movement of the dead locking member from its dead locking position to its passive position.

12. A door lock according to claim 11, wherein the force transmission lever has an end, and pivotal movement of the force transmission lever when the dead locking member is in the dead locking position causes the end of the force transmission lever to engage the dead locking member and move it to its passive position.

13. A door lock according to claim 11, wherein the latch bolt body has upper and lower surfaces that are substantially perpendicular to the pivot axis, and is formed with a passage that extends through the lock bolt body and opens at the upper and lower surfaces, the passage being of substantial extension in the direction of movement of the latch bolt, and wherein the force transmission lever extends within the passage of the latch bolt body.

14. A door lock according to claim 8, comprising an auxiliary bolt having a bevelled end and movable linearly between a projecting position, in which the auxiliary bolt projects from the lock casing, and a retracted position, in which the auxiliary bolt does not project substantially from the lock casing, said auxiliary bolt, when in the projecting position, preventing movement of the dead locking member from its passive position to its dead locking position.

15. A door lock according to claim 14, comprising an operation device, a setting member coupled to the operation device for moving the dead locking member to its passive position, and second spring means effective against the setting member to urge the dead locking member towards its dead locking position, and wherein the auxiliary bolt engages the setting member when in the projecting position and prevents the dead locking member from being moved to its dead locking position.

16. A door lock according to claim 1, wherein the latch bolt body and the latch bolt member have stop surfaces which cooperate with each other to limit the range of pivotal movement of the latch bolt member relative to the latch bolt body, such that in each end position of the range one of said two opposite faces of the wedge portion of the latch bolt member is substantially parallel with the direction of linear movement of the latch bolt.

17. A door lock according to claim 1, comprising an auxiliary bolt spaced from the latch bolt along the pivot axis, the auxiliary bolt being movable linearly, parallel to the direction of movement of the latch bolt, between a projecting position, in which the auxiliary bolt projects from the lock casing, and a retracted position, in which the auxiliary bolt does not project substantially from the lock casing, said auxiliary bolt, when in the projecting position, preventing operation of the dead locking means.

18. A door lock according to claim 17, wherein the auxiliary bolt has a bevelled end, and comprising second springs means urging the auxiliary bolt towards the projecting position.

* * * * *